US008136172B1

(12) United States Patent
Edgecombe

(10) Patent No.: US 8,136,172 B1
(45) Date of Patent: Mar. 20, 2012

(54) SCENTED TOILET SEAT

(76) Inventor: Godfrey O. Edgecombe, Freeport (BS)

( * ) Notice: Subject to any disclaimer, the term of this patent is extended or adjusted under 35 U.S.C. 154(b) by 420 days.

(21) Appl. No.: 12/466,773

(22) Filed: May 15, 2009

Related U.S. Application Data

(60) Provisional application No. 61/057,495, filed on May 30, 2008.

(51) Int. Cl.
*A47K 13/00* (2006.01)

(52) U.S. Cl. ..... 4/237

(58) Field of Classification Search ..... 4/222, 228.1, 4/229, 237
See application file for complete search history.

(56) References Cited

U.S. PATENT DOCUMENTS 1,712,816 A * 5/1929 Elliott ..... 4/229
3,420,445 A * 1/1969 Inzerill ..... 239/274
4,670,916 A * 6/1987 Bloom ..... 4/231

* cited by examiner

*Primary Examiner* — Charles Phillips
(74) *Attorney, Agent, or Firm* — Gold & Rizvi, P.A.; H. John Rizvi; Glenn E. Gold

(57) ABSTRACT

A scent delivery device, the device comprising a standard shaped toilet seat, a hollow inner channel that runs in the body of said toilet seat, a set of holes in fluid communication with said hollow inner channel, and a scent activating component in fluid communication with the hollow inner channel of the toilet seat through a hose. Said scent activating component comprises a scent aerosol and a valve capable of being opened through a timer when a signal is received from weight sensors located on the bottom surface of the toilet seat.

7 Claims, 2 Drawing Sheets

SCENTED TOILET SEAT

CROSS-REFERENCE TO RELATED APPLICATION

This Non-Provisional Utility application claims the benefit of U.S. Provisional Patent Application Ser. No. 61/057,495, filed on May 30, 2008, which is incorporated herein in its entirety.

BACKGROUND OF THE INVENTION

1. Field of the Invention

Bathrooms can often have a noticeable unpleasant odor. This can be embarrassing when company is visiting and using the facilities. Many bathroom users become embarrassed of the odor left behind upon exiting the bathroom. These unwanted smells could also permeate an entire home.

The present invention relates in general to a toilet deodorizing system and more particularly to a new automatically-activated scent delivery device integrated to the toilet seat for distributing air freshener in several different directions and thus improving on the unpleasant odors that may currently exist. This item is ideal for public or private restrooms.

2. Description of the Prior Art

Bathroom deodorizers are very well known in the art. Many attempts have been made to control the odor that is commonly found in a bathroom containing a standard toilet as such odors are offensive and embarrassing. Most commonly, various spraying devices have been used in the air surrounding the toilet. One prior art method teaches manually spraying the toilet area with an aerosol deodorant spray before and/or after use of the toilet. Even though this method is effective for masking the odor, it is not very practical for public bathrooms, since there is a natural reluctance to touch things in public restrooms including the toilet seat, faucets, etc. Moreover, this spraying method of controlling odors cannot be applied at the source of the odor, a toilet bowl, while the toilet was in use. Additionally, a user is exposed to the chemicals composing the aerosol deodorant, and for that reason many users do not use these types of aerosol deodorant sprays.

It is also possible to reduce the unpleasant odors by exhausting the foul smelling air out of the building by means of an exhaust fan and associated ductwork. This method requires expensive installation, generates considerable noise when in operation, requires the toggling of an on-off switch for operation, and is not available in older houses or in all bathrooms in many newer houses and offices. Exhausting the air requires a fan using electric power during its operation. Normally neither the fan shutters nor exhaust ducts are insulated, and there is a small amount of air leakage through the shutters, all of which constitute additional energy loss. So this odor handling method is both inconvenient and uses excessive energy for its operation.

Another known solution involves filtering escaping odor directly from within the bowl requiring complex external fans, ductwork, and power systems. Additionally, venting of the toilet bowl before the odor escaped often required modification of the standard toilet and the placement of unsightly and possibly unsanitary ductwork into the toilet bowl. In addition to being expensive these systems are difficult to install and maintain.

Other less complicated deodorant delivery systems involves slowly dissolving scented solids placed in a toilet water reservoir adding perfume to water used for flushing as a means of neutralizing bathroom odor. Most of this treated water is lost during flushing. The small amount of treated water remaining in the toilet bowl is diluted considerably by untreated water added to bring the water level up to the proper height during a reservoir refilling cycle. As a result, the small amount of perfumed water remaining in the toilet bowl is insufficient to adequately cover either odor in the water or odor escaping into the air during a bowel movement. Another additional means of odor control is therefore required for complete control of bathroom odor. This is an inefficient, inadequate and expensive means of odor control. The same method has the alternative of using the scented solids inside a plastic aerosol including a hook capable of being fastened and positioned against the inside of the toilet bowl, under the rim. Thus, the aerosol catches water flow every time the user flashes the toilet, dispensing the product in the bowl and delivering a scent to the air. This method is effective to keep the toilet bowl clean and somewhat scented and fresh, but ineffective for masking the odor usually present in the bathroom air.

Another know method involves the natural evaporation of solid perfumes that produce an unnecessary constant background scent and require frequent replacement if the evaporation rate is set high enough to adequately cover the odor. This requires the frequent replacement of the perfumed material and sometimes an unneeded scent of other rooms and corridors when the bathroom door is left open.

Another way of removing unpleasant odors from a room is the conventional method of bathroom ventilation involving the removal of bathroom odors after the odors departure from the toilet bowl and dispersion in the ambient air. Modern bathrooms tend to be small windowless rooms with tiny, inadequate exhaust fans mounted in the ceiling with ducting leading to the outdoor air. Upon activation, said systems attempts to draw odorous air out of the bathroom. Because the odor is removed after its dispersion from the toilet, said systems require lengthy operation time to ventilate the entire bathroom area and are thus are often ineffective in removing the odor.

Because of the poor results obtained with said ceiling exhaust fans, the development of ventilating means which draws the unwanted gases and odors directly from the toilet bowls before the odors can disperse into the surrounding air has been encouraged. These systems can expel the odorous air into an air filtration unit or to the outdoors through a ventilation duct. Even though good results may be obtained, its installation and maintenance are extremely expensive.

Many of these toilet ventilation systems are technically complex and relatively high cost to manufacture, requiring a whole new toilet installation. Therefore they do not represent an easy-mounting solution, compatible with the existing toilet configurations.

Moreover, many of the toilet ventilation systems require a dedicated wall ventilation duct near the toilet. As many bathrooms do not have such an available duct, this type of ventilated toilet installation would require expensive structural modification of the building to provide for the ventilation conduits.

Another drawback of these ventilated solutions use weak electrically operated fans that cannot possibly move enough air on a regular basis to effectively perform the job of removing odors from the bowl before they spread into the bathroom.

Other designs incorporate air duct passageways that are far too small to move enough air to make the units effective. With these tiny passageways, the only way to move enough air involves unacceptable obnoxious noise coming from powerful fan units.

Many of the ventilation units known involve also bulky components that are visible to a person using the toilet, which detracts from the overall appearance of the bathroom.

Many prior art designs use devices that present cleaning and odor problems that is inherent when the units mount on or adjacent to the toilet since these designs use ductwork passages that are exposed to the toilet bowl and can easily become contaminated. Keeping these toilet area parts clean can be a challenge, considering the normal toilet bowl environment. Since they can be very hard to clean, infectious waste can collect there and can then produce more odor to the bathroom environment than the system is trying to eliminate.

In general, none of the existing ventilation systems for removing odors directly at the toilet have been commercially successful. There is a set of drawbacks related to its installation, function and maintenance that turn them inappropriate.

Therefore, known dispensers for products and known ventilation processes tend to be ineffective, complicated, messy, and limited. Notwithstanding the potential of these prior art attempts to solve the bathroom odor problem, an adequate and effective solution is still pending.

Accordingly there exists a need for an improved toilet deodorizer device integral with the toilet seat and designed specifically to facilitate the dispensing of the deodorizer into and outside of the toilet bowl in a clean and effective manner capable of effectively masking those odors when desired by the user.

SUMMARY OF THE INVENTION

The present invention is directed to a device used in conjunction with a traditional toilet in order to disperse a pleasant smelling spray into the air. This product looks similar to a traditional toilet seat but has approximately 12 hidden spray holes at the bottom. Four holes spray a scented mist into the toilet bowl and four others spray towards the ground. Four other discreet holes distribute freshener to the sides of the toilet. An activating component may be located at the bottom of the seat. This device may be activated by weight being applied. The activator is attached to the toilet seat by a hose at the back of the toilet. This product may be electrically or battery powered for use.

Several objects and advantages of the present invention are:

a) to automatically disperse a pleasant smelling spray directly into the toilet bowl, neutralizing the odor while it is still confined within the toilet bowl, without the user intervention.

b) to disperse a scented spray outside the toilet bowl without spraying the substance on the user.

c) to eliminate the need for using ventilating systems involving exhaust fans to remove odor in a bathroom, thereby saving energy.

d) to provide automatic dispensing means for the odor suppressing and odor neutralizing substance with minimum intervention by the user.

e) to use an easy-to-install and economical solution with no impact upon the structure of the bathroom and the environment.

f) to create an inexpensive method of bathroom odor control by using an automatic and efficient deodorizing method.

g) to distribute air freshener in several different directions at the same time improving on the unpleasant odors frequently present in bathrooms.

Summing up, in one general aspect the present invention comprises:

a standard shaped toilet seat, a hollow inner channel in the body of said toilet seat, a set of holes in fluid communication with said hollow inner channel;

a scent activating component in fluid communication with the hollow inner channel of the toilet seat, a replaceable aerosol loaded with scent, in fluid communication with an electrical valve, located inside the scent activating component.

Another aspect of the present invention provides three different sets of holes in fluid communication with the hollow inner channel of the toilet seat. One set comprising four holes to spray a scented mist into the toilet bowl; another set comprising four holes to spray towards the ground, and the last set of four other discreet holes distributing freshener to the sides of the toilet.

Yet another aspect of the invention the hollow inner channel runs around the whole perimeter of the toilet seat.

In a further aspect of the present invention, the activating component comprises a scent aerosol and an electrical valve, capable of delivering scent when an electrical signal is received from sensors located on the bottom surface of the toilet seat.

In still a further aspect of the invention, the activating component is in fluid communication with the hollow inner channel through a hose.

In yet another aspect the activating component is electrically-powered.

In yet another aspect the activating component is battery-powered.

In yet another aspect the activating component comprises a scent aerosol including a valve connected to a timer. This timer is connected to the sensors located on the bottom side of the toilet seat and to the electrical outlet of the bathroom.

These and other aspects, features, and advantages of the present invention will become more readily apparent from the attached drawings and the detailed description of the preferred embodiments, which follow

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF REPRESENTATIVE EMBODIMENTS

Figure 1:
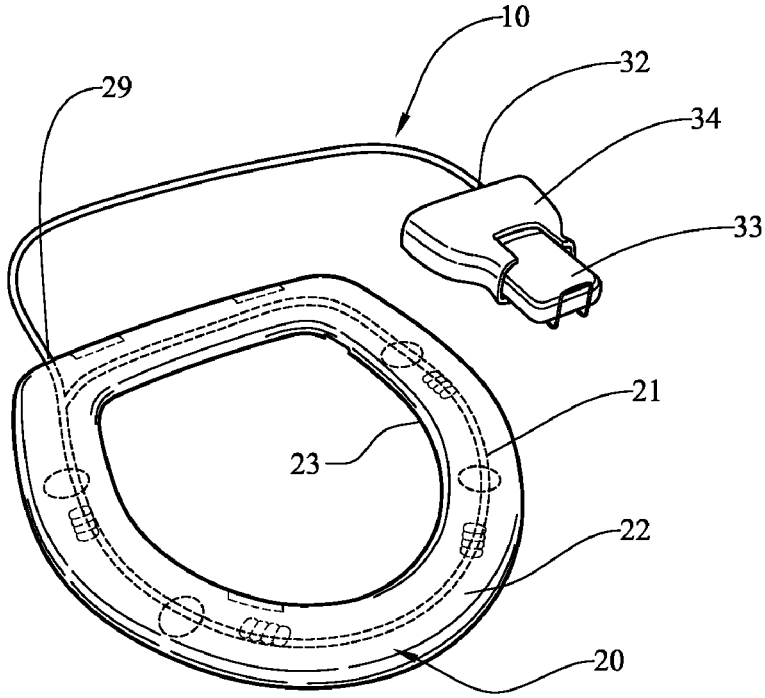
FIG. 1 is a top schematic perspective view of the scent delivery device showing its parts in detail before its installation to a toilet bowl. The inner channel, through which the scent is delivered, is shown (see dotted lines).
Figure 2:
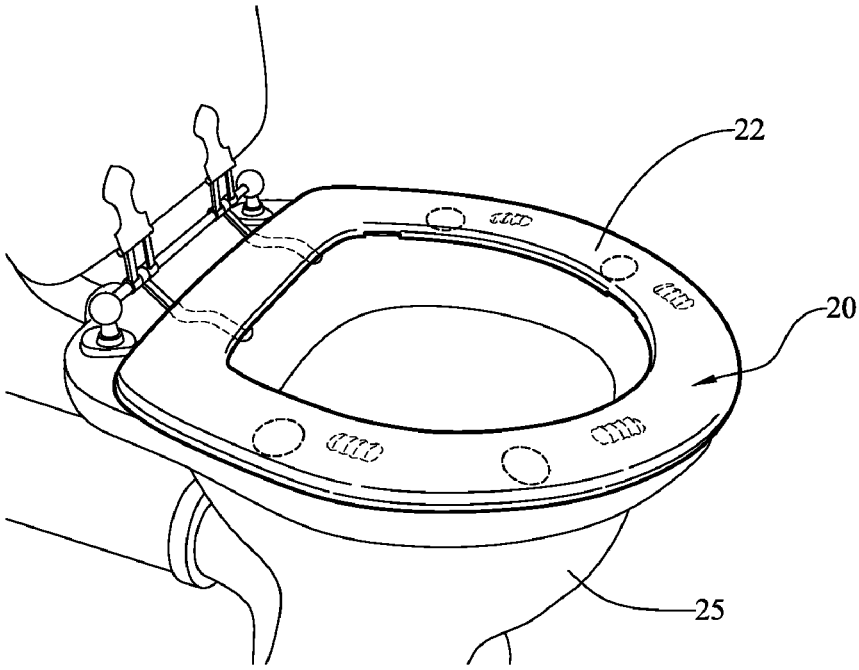
FIG. 2 is another top perspective view of the purposed device, this time already installed to a toilet bowl.
Figure 3:
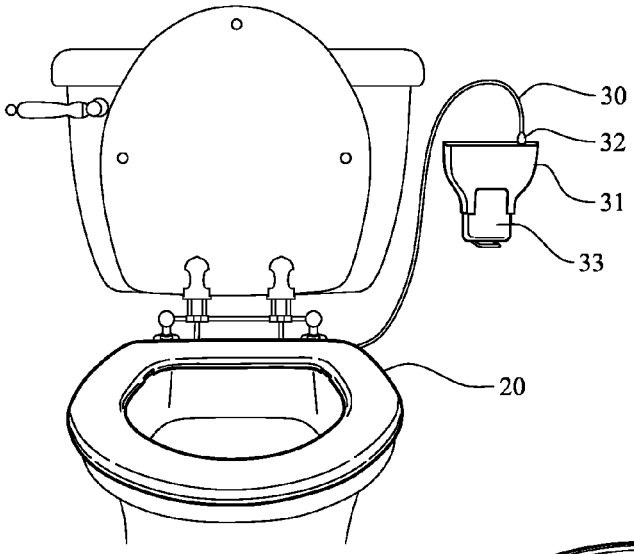
FIG. 3 is a front perspective view of the device installed to a toilet bowl.
Figure 4:
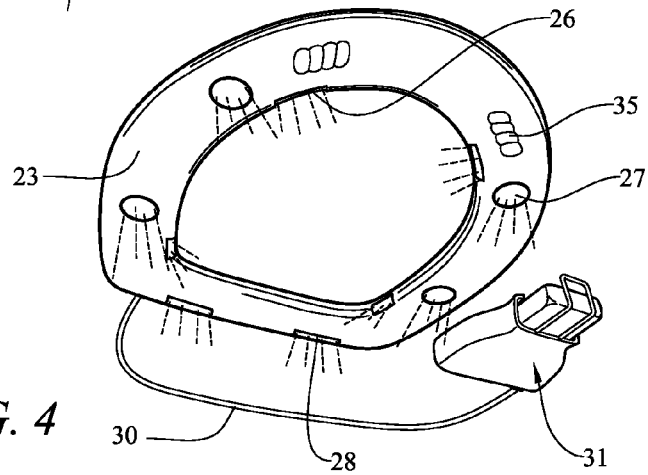
FIG. 4 is another top perspective view, similar to FIG. 1, this time showing how the air freshener may be sprayed through the holes located in different strategic position of the toilet seat; finally.

Shown throughout the figures, the invention is directed to an automatic scent delivery device 10, comprised of a standard shaped toilet seat 20 that forms a hollow inside delivery channel 21 that runs inside and around the body of the toilet seat 10. In the disclosure that follows, the present invention will be described in terms of a standard shaped residential toilet seat 20, but it can also be applied to a split toilet seat typically used in commercial applications as well. The hollow inside channel 21 is formed inside the toilet seat 20, between the top surface 22 on which the user sits and the bottom flat surface 23 of the toilet seat 20. This channel defines a conduit in fluid communication to the scent recipient and the delivery holes, as will be explained below.

Said inside channel 21 runs around the whole perimeter of the toilet seat (as is clearly shown in FIG. 1—see dotted lines) creating a fluid delivering channel for the scent spray as will be explained in detail below.

The bottom surface 23 of the toilet seat includes several spacers 24 to prevent the toilet seat 20 and the toilet 25 from coming into contact and forming a tight seal. In fluid communication with said inner channel 21, the bottom surface 23 includes three sets of scent delivering holes indicated with reference numbers 26-27 and 28.

Figure 5:
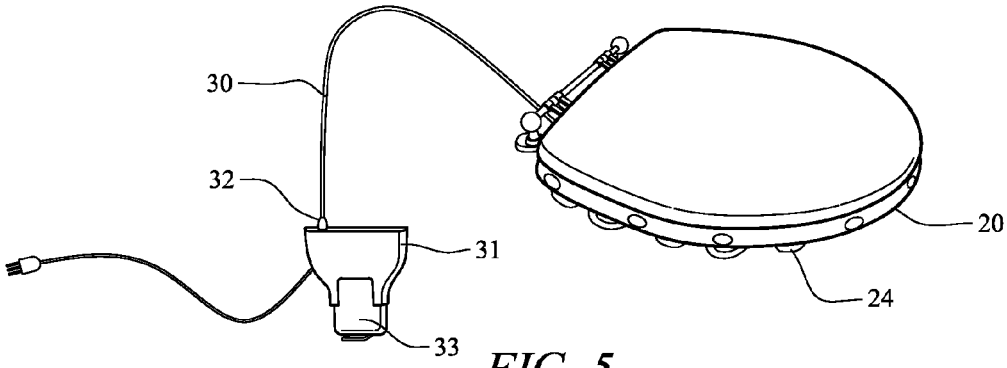
FIG. 5 is another perspective view illustrating the toilet seat in a closed position, including a schematic diagram of the electrical connections involved and also showing a closer view of the holes through which the scent is sprayed into and outside the toilet bowl.

Making reference to FIGS. 1 and 5, said set of holes comprises four holes 26 to spray a scented mist into the toilet bowl, four holes 27 to spray scent towards the ground and four discreet holes 28 to distribute freshener to the sides of the toilet. These holes allow an efficient and even dispersion of the scent loaded in the scent aerosol 33.

At the back of the toilet seat 20, near the common hinged connection found on most toilets, a rear opening or inlet 29 is formed. This rear opening 29 is in fluid communication with said inner channel 21 and serves as an exhaust port. To this rear opening 29 the end of a hose 30 is connected, the other end of which is connected to the outlet 32 of an activating component 31. Said activating component 31 comprises a scent aerosol 33, in which the scent spray is loaded under pressure, and an operational device 34, responsible of dispersing the scent loaded in the aerosol 33 to the hose 30 and consequently to the inner channel 21 of the toilet seat 20. A sensor 35 located on the bottom surface 23 senses a user by weight, and activates said operational device 34. Said activating component 31 includes a timer that goes off when a user seated on the toilet seat 20 is sensed. Said timer is electrically connected to one of the bathroom electrical outlets through an electrical wire (see FIG. 5).

The presence and orientation of the inner channel 21 is one distinguishing feature of the present invention. This channel 21 is specifically designed and oriented to form a flow of scent inside of the toilet seat towards the delivering holes, creating a midst of scent inside and outside the toilet 25.

In one embodiment of the present invention, the activating component 31 is electrically powered by an electrical wire connected to an electrical outlet of the bathroom in which the toilet is located.

In another embodiment of this invention 10, the activating component is battery-powered and standard or rechargeable batteries can be used.

As can be clearly seen from the attached figures, said activating component comprises a compact unit that may be installed behind the toilet without detracting from the overall appearance of the bathroom.

In summary, the scent is drawn from the scent aerosol 33 into the hollow inner channel 21, the holes 26, 27 and 28.

The best mode of the present invention employs the toilet seat 21 mounted onto a toilet 25 via the common hinged connections found on toilets. When the user of the toilet 25 sits on the toilet seat 21, the weight of the user is detected by sensors 35 which will send an electric signal to the activating component through electrical wires (not illustrated). This signal will trigger off a timer that controls the aerosol valve, creating a scent flow for a predetermined period of time, delivering the scent loaded in the aerosol to the hose 30. As said hose 30 is in fluid communication with the inner channel 21, said scent is delivered to said channel and consequently to the holes 26-27 and 28 creating a midst into the toilet through holes 26, towards the ground through holes 27 and to the sides of the toilet through holes 28.

While the preferred embodiments of the invention have been described above, it will be recognized and understood that various modifications can be made in the invention and the appended claims are intended to cover all such modifications which may fall within the spirit and scope of the invention

I claim:

1. A scent delivery device, the device comprising:

a standard shaped toilet seat;

a hollow inner channel formed into a body of said toilet seat;

three sets of holes formed in a bottom surface of said toilet seat and in fluid communication with said hollow inner channel, the first set of holes configured to direct a spray of scented mist into an interior region of the toilet bowl, a second set of holes configured to direct a spray of scented mist towards a ground surface, the third set of holes configured to direct a spray of scented mist towards sides of the toilet bowl, wherein said spray of scented mist from each of said first, second and third set of holes is simultaneously dispersed therefrom;

a scent activating component; and at least one weight sensor located on said bottom surface of said toilet seat, electrically connected to said scent activating component.

2. The scent delivery device, as recited in claim 1, wherein the set of three holes in fluid communication with said hollow inner channel of said toilet seat, said first set of holes comprising at least four holes to spray a scented mist into the interior region of the toilet bowl, said second set of holes comprising at least four holes to spray a scented mist towards the ground surface, and said third set of holes comprising at least four other discreet holes distributing a spray of scented mist to the sides of the toilet bowl.

3. The scent delivery device, as recited in claim 1, wherein said hollow inner channel runs around a whole perimeter of said toilet seat.

4. The scent delivery device, as recited in claim 1, wherein said scent activating component includes a replaceable aerosol loaded with scent, in fluid communication with an electrical valve, located inside said scent activating component; which in turn is in fluid communication with said hollow inner channel of said toilet seat through a hose.

5. The scent delivery device, as recited in claim 4, wherein said electrical valve of said scent activating component is connected to a timer which, in turn, is electrically connected to said at least one weight sensor.

6. The scent delivery device, as recited in claim 5, wherein said timer of said scent activating component is electrically-powered.

7. The scent delivery device, as recited in claim 5, wherein said timer of said scent activating component is battery-powered.

* * * * *